US005354063A

United States Patent [19]

Curchod

[11] Patent Number: 5,354,063

[45] Date of Patent: Oct. 11, 1994

[54] DOUBLE POSITION GOLF SIMULATOR

[75] Inventor: Donald B. Curchod, Portola Valley, Calif.

[73] Assignee: Virtual Golf, Inc., Mt. View, Calif.

[21] Appl. No.: 984,948

[22] Filed: Dec. 4, 1992

[51] Int. Cl.[5] ..... A63B 69/36

[52] U.S. Cl. ..... 273/185 B

[58] Field of Search ..... 273/185 B, 185 A, 185 R, 273/184 R

[56] References Cited

U.S. PATENT DOCUMENTS

| | | | |
|---|---|---|---|
| 3,589,732 | 6/1971 | Russell | 273/185 B X |
| 3,620,537 | 11/1971 | Conklin | 273/185 B X |
| 3,697,073 | 10/1972 | Dooley | 273/185 B X |
| 3,729,315 | 4/1973 | Conklin et al. | 273/185 B X |
| 3,778,064 | 12/1973 | Nutter | 273/185 B X |
| 4,086,630 | 4/1978 | Speiser et al. | 273/185 B X |
| 4,437,672 | 3/1984 | Armantrout et al. | 273/185 B |
| 4,767,121 | 8/1988 | Tonner | 273/185 B X |
| 5,020,802 | 6/1991 | af Strom | 273/185 R |

FOREIGN PATENT DOCUMENTS

| | | | |
|---|---|---|---|
| 4322672 | 11/1992 | Japan | 273/185 B |
| 2154146 | 9/1985 | United Kingdom | 273/185 B |

OTHER PUBLICATIONS

"Golfmat", *The Journal*, Buzz McClain, Feb. 1991, pp. A12–A13.

*Primary Examiner*—William E. Stoll
*Attorney, Agent, or Firm*—Patrick T. King

[57] ABSTRACT

An improved golf simulation system for two players is contained in a single booth, which has a single screen on which are projected various views of simulated golf holes and into which two golfers independently but concurrently hit golf balls from within the single booth, a dual-player golf simulator system. Each player uses a portion of a golf tee area. Ball flight sensors sense the flight of the two independently, concurrently hit golf balls. A computer concurrently computes the flight and landing location of the first golf ball on the simulated hole and the flight and landing location of the second golf ball on the simulated hole as a function of the sensed velocity, trajectory, and spin of each of the respective golf balls. The simulated golf hole can be viewed as a single view of as a split view when each player has a different viewing location.

26 Claims, 7 Drawing Sheets

HOLE 1 PAR 4
PLAYER A 200Y TO GO
PLAYER A 212Y HIT

NEXT PLAYER D

90

HOLE 1 PAR 4
PLAYER C 200Y TO GO
PLAYER C 157Y HIT

NEXT PLAYER B

91

HOLE 4 PAR 3
PLAYER A 212Y HIT
200Y TO GO

NEXT PLAYER D

90

HOLE 4 PAR 3
PLAYER C 150Y HIT
160Y TO GO

NEXT PLAYER B

91

DOUBLE POSITION GOLF SIMULATOR

BACKGROUND OF THE INVENTION

1. Field of the Invention

This invention relates to golf simulation and, more particularly, to an improved golf simulator which increases the number of players simultaneously using a simulator, thereby reducing the time taken to play a simulated round of golf by more than one player.

2. Prior Art

Prior art golf simulator systems provide a simulator booth which includes a "tee" area and a projection screen. A golfer hits a golf ball from the tee area towards the projection screen. The tee area has tees and mats for simulating tee and fairway surfaces. The tee area has sensors for determining the speed, direction, and spin of a golf ball. This requires a golfer to stand in a tee area and hit a golf ball towards the projection screen on which is projected a view of the hole from various places along a simulated fairway. The views projected correspond to those that the golfer would view from the position where the golfer's ball lies after the ball is hit.

In the past, golf simulator booths were configured so that only one player at a time can set up and play a ball from approximately the center of the simulator booth. The width of the booth was wide enough so that only one golfer could hit either as a right-handed or as a left-handed player.

What has been observed in current and past golf simulators is that an average foursome typically takes four hours or more to complete 18 holes of golf. This time is not much different than that taken for outside golf on a real course. Because three players of the foursome can only watch and wait, the slow play on a simulator leads to frustration and has a negative impact on the performance of the players.

On a real golf course, after teeing off, the golfers in a foursome typically disperse to various areas of the fairway and play the simulated course in a "parallel" fashion. By this is meant that each member of the foursome can individually progress toward the green. Each of the players in this parallel fashion can separately plan, setup, execute, and savor their next shot, while the other players are doing the same. They all converge again at the green and on the next tee area. Typically, except for the tee and green areas, golfers on a real golf course progress in this parallel fashion towards the green. The players must "serially" strike their balls only at the tee and on the putting green. Even on the tee and on the putting green, the players to some extent can do some individual preparation prior to teeing off or putting.

In present golf simulators, all of the playing partners must wait while the player currently on the tee goes through a sequence of activities. The activities include viewing the terrain, planning the shot, selecting an appropriate club, setting up the shot, hitting the shot, watching the ball fly, and savoring the shot. The simulator then determines which player is next up and causes the view on the screen to change from one view to the next view. The next player then repeats the same sequence of activities for the next shot.

In comparison with play on a real golf course, this "serial" use of the simulator by only one player at a time slows play and the pace of the game. It also wastes time and causes frustration for the waiting players. While it might be expected that playing a round of golf on a golf simulator would be significantly faster than on a real golf course, in practice it has been found that the "serial" use of a simulator by a group of players causes play to be much slower than desired. For commercial establishments, it is desirable to have the highest possible throughput, that is, have as many players as possible using the simulator per hour. Because of the high capital investment and ongoing expenses for booth space required for a simulator system, merely duplicating simulator booths is not a viable economic solution because it does not speed up play for a group of golfers playing together.

Consequently, the need has arisen for a golf simulator system which has increased player throughput and efficient utilization of space, while still maintaining the quality of play.

SUMMARY OF THE INVENTION

It is therefore an object of the invention to provide an improved golf simulator system which, while using approximately the same booth space, substantially increases the speed at which two or more golfers can together play a simulated round of golf.

In accordance with this and other objects of the invention, a single golf simulator booth is provided, which is occupied and used by two golfers at the same time. A single screen is provided on which are simultaneously projected the same view or various views of the same golf hole or independent golf holes. The two golfers independently view. set up, or hit golf balls from within the same booth at the screen. The golf simulator system includes a tee area which is split into a first portion occupied by a first right-handed golfer. A second portion of the golf tee area is occupied by a second, right-handed golfer who can play independently or concurrently with the golfer on the same or separate simulated holes. Ball flight sensing means sense the flight of each of two independently hit golf balls, one ball having been hit by the first golfer and the second ball having been hit by the second right-handed golfer. Means are provided for differentiating the flight of the first ball and the second ball when both balls are hit concurrently.

A computer concurrently computes the flight and landing location of the first golf ball on a simulated first hole and the flight and landing location of the second golf ball on the simulated same hole or a second hole as a function of the sensed velocity, trajectory, and spin of each respective golf ball. A projection means is controlled by the computer for simultaneously projecting onto a portion of the single screen the first simulated golf hole, as viewed from the location of the first ball. A second simulated portion of the same golf hole, as viewed from the location of the second ball is projected onto a second portion of the screen.

Ball flight sensors are provided which allow the ball flight to be sensed from each of the tee areas. Computer interface means, such as a keyboard and a display screen, are provided to allow each of the golfers to selectably play either singly, independently, and/or concurrently the various simulated golf holes. The system can provide either one view of the same simulated golf hole for both golfers or separate views of the same or different simulated golf holes.

In a preferred embodiment of the invention, the multi-user golf simulation system includes a first tee area with a first sensor means for sensing the velocity, trajectory, and spin of a first golf ball hit from the first tee area. A second tee area has second sensor means for sensing the velocity, trajectory, and spin of a second golf ball hit from the second tee area. Computer means are provided for concurrently computing the flight, distance, and location of the first golf ball from a simulated first hole and of the second golf ball from the same simulated hole or a second hole as a function of the measured velocity, trajectory, and spin of each of the golf balls. Image display means, controlled by the computer means, can simultaneously display the image of the simulated golf hole from the location of the first ball and the second simulated view of the same or second golf hole from the location of the second ball.

The ball flight sensing means can be one sensing means which detects flight data for ball from two separate tee areas. The ball can be calculated either directly by ball flight sensors or indirectly approximated by sensing the velocity, path, and angle of a golf club head just prior to or at impact with a golf ball.

A method is provided according to the invention for simulating a golf hole or a game for two golfers in a single golf simulator booth having a single screen on which are projected various views of simulated golf holes. The method includes the steps of having a first golfer strike a first ball from a first portion of a tee area. A second right-handed player strikes a second ball from a second portion of the tee area. The next step is to sense the flight of the two independently hit golf balls and to independently, and possibly concurrently, compute the landing location of the first golf ball on a simulated first hole and the landing location of the second golf ball on the same simulated hole or a second hole as a function of the sensed velocity, trajectory, and spin of each of the golf balls. The method includes the step of simultaneously projecting onto a portion of the single screen the first simulated golf hole as viewed from the location of the first ball and projecting onto a second portion of the screen the same simulated golf hole as viewed from the location of the second ball or a second view of a second simulated golf hole. The flight of each ball can be independently sensed with sensors.

The left and right hand balls can be distinguished, for example, by displaying a white ball for the golfer on the left-hand tee and a yellow ball for the golfer on the right-hand tee, or by some other distinguishing means. Each of the golfers can select either to play singly, independently, and/or concurrently various simulated golf holes. The identical view of the same simulated golf hole can be projected for both golfers or two separate, split-screen views of the same simulated golf hole can be projected.

An advantage of the improved golf simulator system according to the invention is that it takes approximately the same booth space as a conventional single-user golf simulator system. This improved golf simulator system halves the effective per-player time and doubles the amount of revenue per unit time. This improved golf simulator system for more than one player essentially cuts a player's playing time in half. Using a split screen, this improved golf simulator system permits players to simultaneously play separate holes or the same hole from different positions on the hole. This system also doubles the effective per-player service life of golf simulator system components by doubling the speed of play.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
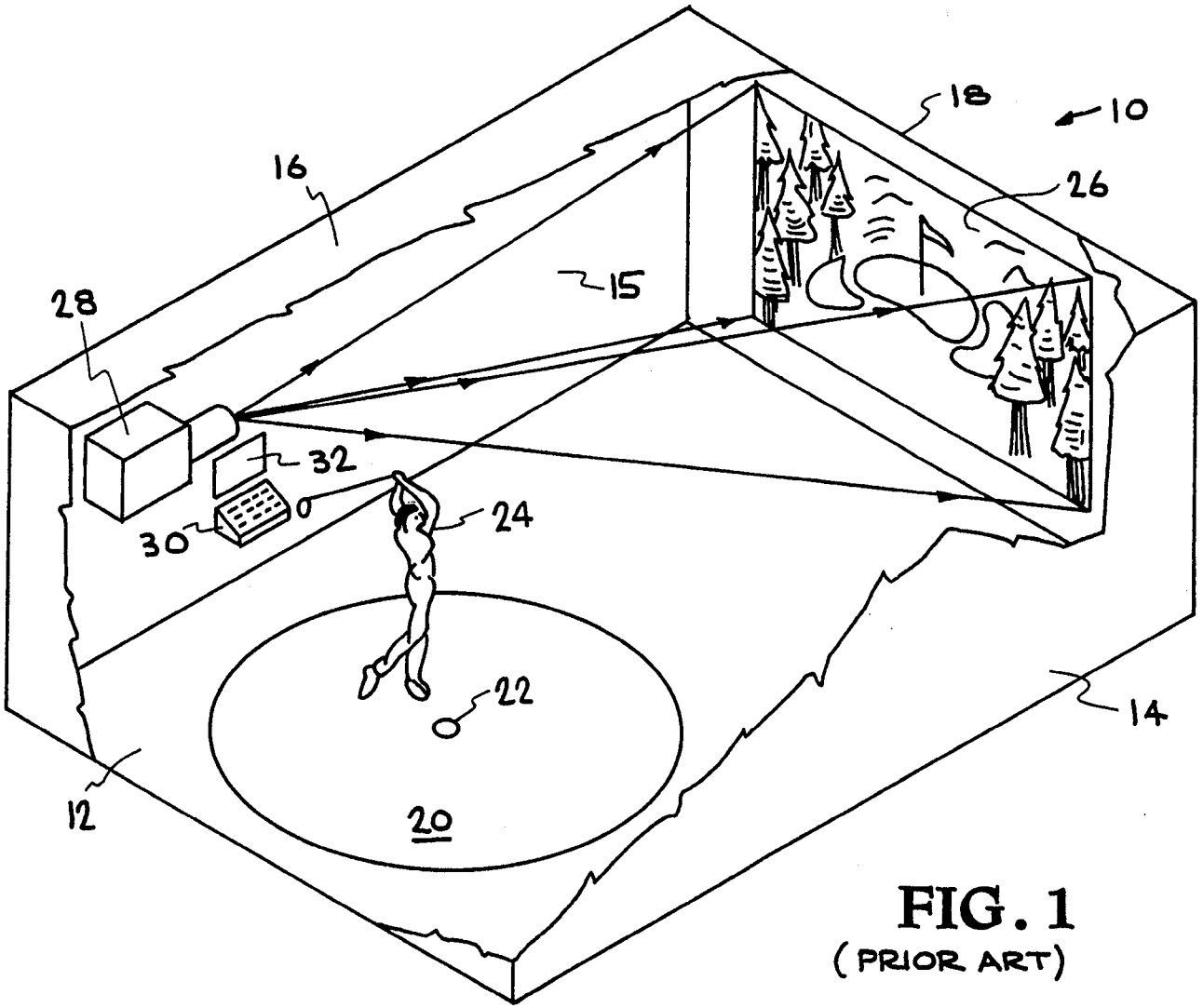
FIG. 1 (PRIOR ART)
FIGURE 1 is a perspective, cutaway view of a conventional, single-user, golf simulator booth having a single tee area.

FIG. 1 shows a conventional, single-user, golf simulator booth 10, which typically has an open front end 12, two side walls 14, 15, a ceiling 16, and a closed far end wall 18. Near the open front end 12 of the booth is a single tee area 20 with a single tee 22 located near its center. The tee area 20 is designed so that a golfer 24 can stand on either side of the tee to strike a ball on the tee 22. In this manner, either a right-handed or a left-handed golfer can hit a golf ball from the tee area 20 towards the far end wall 18 of the booth 10.

Next to the far end wall 18 of the booth is a large vertical screen 26. Typically, the image on the screen is a view of a particular hole on a golf course where the view is selected to match a simulated golf-course location, which corresponds to the location of the ball which is being hit by the golfer 24. A projector 28, which is located near the open front end 12 along the side wall 15 of the booth projects the image on the screen.

Various types of sensors are alternatively provided for determining various flight parameters for a golf ball being hit by the golfer. One type of sensor measures the actual flight of a ball. A second type of sensor measures certain club head parameters such as clubhead speed and the angle of the face of the clubhead. Light sensors are located either near the tee area 20 or adjacent to the screen 26. The screen 26 itself may contain a matrix of impact-sensitive sensor switches.

Information about the ball or the clubhead from the various sensors is processed by a computer (not shown) to determine the distance and location of the golf ball after being hit on the simulated golf hole. The computer controls the projector to provide an appropriate image on the screen 26. A user interface includes a data input keyboard 30 and a data screen 32.

Figure 2:
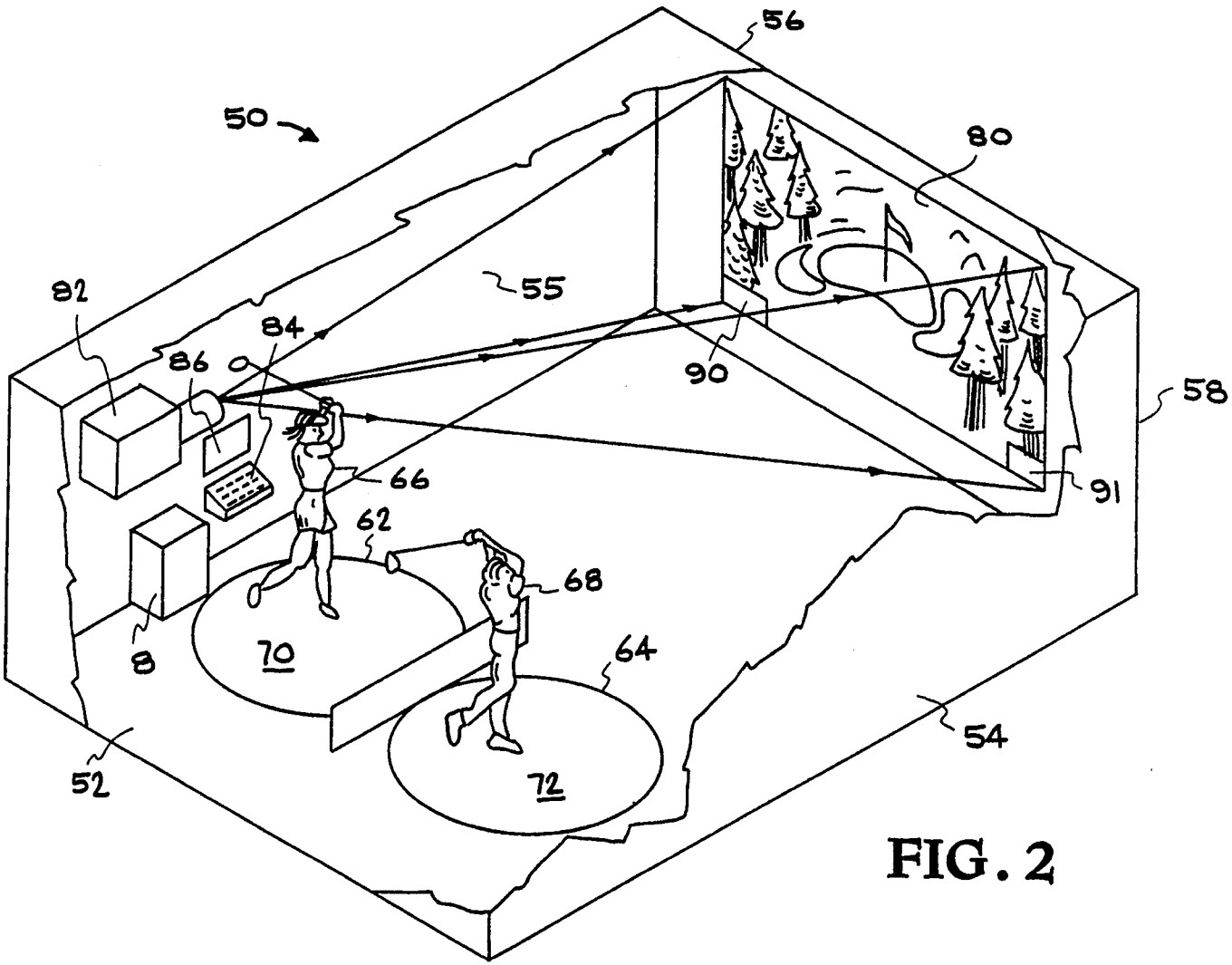
FIG. 2 is a partially cutaway, perspective view of a dual-user golf-simulator booth, which shows a single image on a display screen and which has two tee areas, permitting two golfers to play simultaneously according to the invention.

FIG. 2 shows a dual-user golf-simulator booth 50, according to the invention. The booth is approximately the same size as a conventional booth. The lengths are the same. The minimum width for a single right-handed booth is approximately 11 feet, while the minimum width for a dual booth according to the invention is approximately 15 feet. The booth 50 includes an open front end 52, two side walls 54, 55, a ceiling 56, and a closed far end wall 58. Near the open front end 52 of the booth 50 is a dual tee area 60 which has two tee areas 62, 64, permitting two golfers 66, 68 to play simultaneously or concurrently from respective tees 70, 72, according to the invention. The two tee areas are separated by a low separator board 74. It is intended that the tee areas also include tees upon which golf ball are teed and mats, or the like, from which fairway shots, i.e., unteed shots are played.

Next to the far end wall 58 of the booth 50 is a large vertical screen 80. As illustrated by FIG. 2, sometimes the image on the screen 80 is a single view of a particular hole on a golf course. This occurs when both players are playing at approximately the same location on the simulated hole, for example, when both players are on the tee area. A display box 90 for the left half of the booth 50 is provided in the lower left corner of the display screen. A display box 91 for the right half of the booth 50 is provided in the lower right corner of the display screen. The display boxes can show, for example, which player is currently on the tee, which player is next upon the tee, the distance to the hole, the distance of the last hit, and any other relevant information for the players.

Figures 2A, 2B, 3A, 3B, 8:
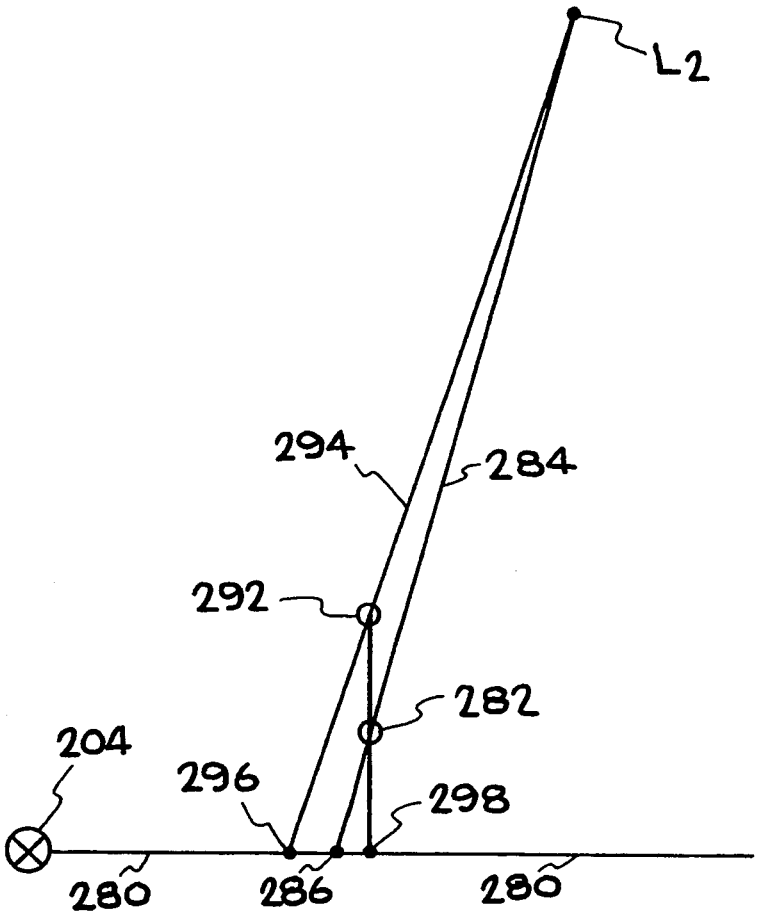
FIGS. 2A–2B are examples of display boxes according to the present invention.
FIGS. 3A–3B are examples of display boxes according to the present invention.
FIG. 8 is a schematic diagram of an elevation view which illustrates a technique for determining the heights of two golf balls above a linear sensor array.

FIG. 2A shows an example of information displayed in display box 90 for Player A on the left tee in the booth. FIG. 2B show an example of information displayed in display box 92 for Player B on the right half tee in the booth. This information includes the hole being played and the value of par for that hole. Note that different holes can be concurrently played by each player. In that case different views are displayed for the different holes. The number of yards from the current location on the course to the hole is displayed. When a player hits the ball, the system computes the number of yards that the ball is hit and displays a message such as "212 YARDS HIT" or "157 YARDS HIT". These messages can be caused to blink as indicated by the dotted enclosure for this message.

Another important piece of information to be displayed is the name of the next player. This message permits the next player to begin preparation for his or her next shot prior to walking onto the tee. Displaying the next player to be up on the tee serves as a means for prompting that player to take up the tee position and to begin mental preparation before the tee position is available.

As shown in FIG. 2, a projector 82, which is located near the open front end 52 of the booth projects the image on the screen 80. A user interface includes a data input keyboard 84 and a data screen 86 which interface with a computer system 88.

Figure 3:
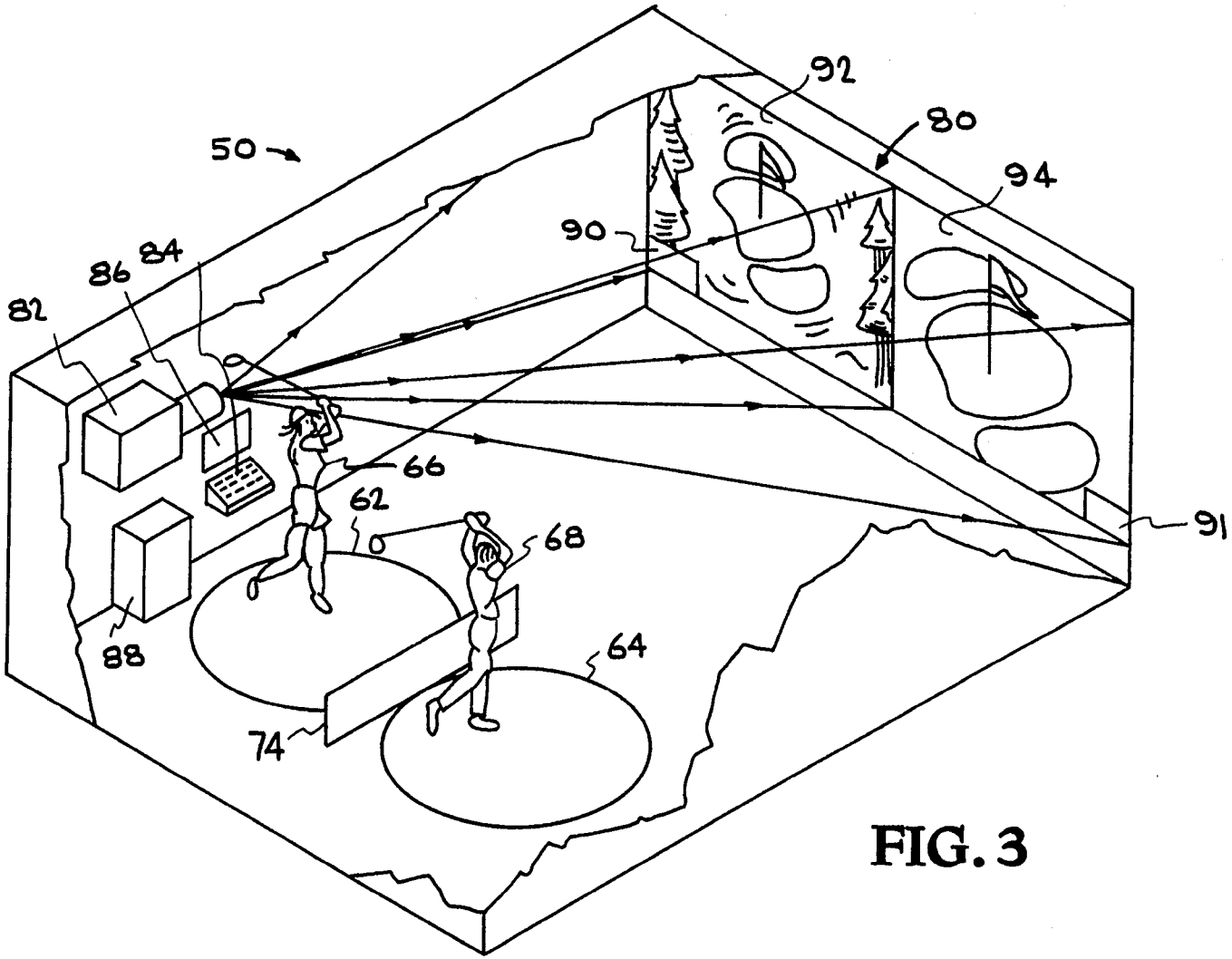
FIG. 3 is a partially cutaway, perspective view of the dual-user golf simulator booth of FIG. 2, showing the projector displaying a split screen image, with a separate view for each golfer at each of the tee areas.

FIG. 3 shows the dual-user golf-simulator booth 50, according to the invention. The projector 82 is displaying a split image on the screen 80. The left half-image 92 corresponds to the view from the location of the first golf ball being hit by the golfer 66. The right half-image 94 corresponds to the view from the location of the second golf ball being hit by the golfer 68. In this case, the players are playing at different locations on the same simulated hole, that is, at different distances from the hole and at different angles with respect to the hole.

FIGS. 3A and 3B show examples of information displayed in the display boxes 90, 91. For example, player A, or 66, may be located at approximately 200 yards from the hole and player C 68 may be located at 160 yards from the hole. Each of the split images represents the respective view for each golfer from their different locations on the simulated golf course. After the players strike their respective balls the display boxes 90, 91 will blink as they display, for example, "212 YARDS HIT" and "157 YARDS HIT" for the respective golfers.

The left and right hand balls can be distinguished, for example, by displaying a white ball for the golfer on the left-hand tee and a yellow ball for the golfer on the right-hand tee, or by some other distinguishing means. Each of the golfers can select either to play singly, independently, and/or concurrently various simulated golf holes. The identical view of the same simulated golf hole can be projected for both golfers or two separate, split-screen views of the same simulated golf hole can be projected.

Figure 4:
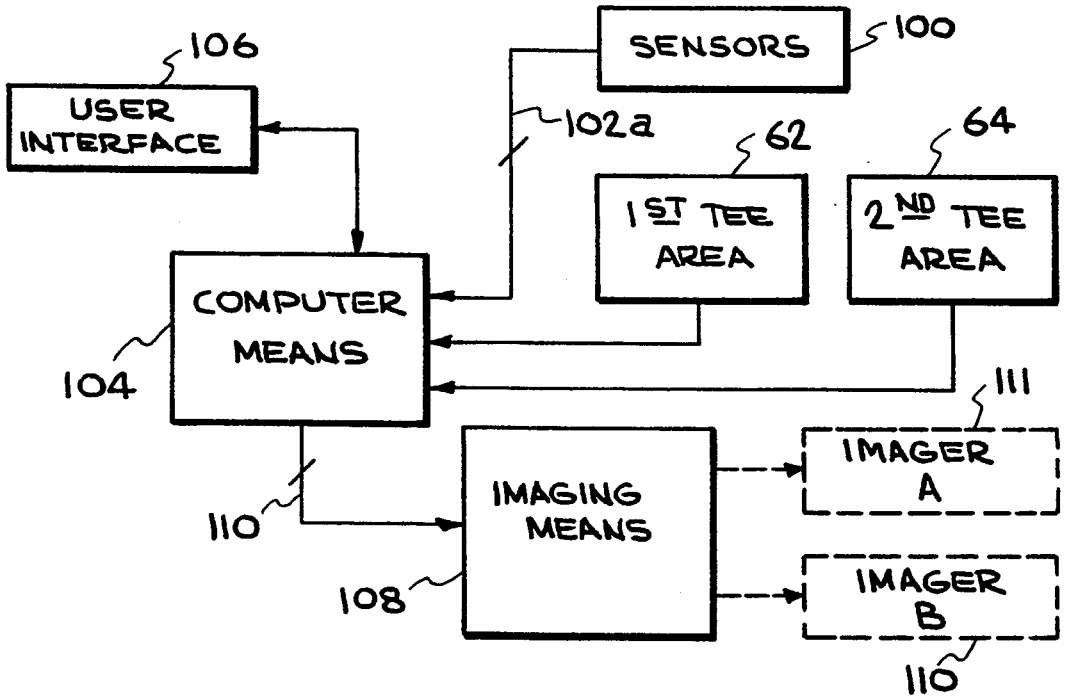
FIG. 4 is an electrical block diagram of a dual-user golf-simulation system according to the invention.

FIG. 4 shows an electrical block diagram of a dual-user golf-simulation system according to the invention. Sensors means 100 are part of a system for determining the flight parameters of a first golf ball hit from the first tee area 62 of the tee area 60 of FIG. 3 and of a second golf ball hit from the second tee area 64 of the tee area 60 of FIG. 3.

Information about the ball or the clubhead from the sensor means 100 is communicated by a bus **102*a* to computer means 104. Information from sensors at the tee areas 62, 64 is communicated on respective buses 102*b* and 102*c* to the computer means 104. The computer means 104, such as the computer 88 of FIG. 3, processes the information from the various sensors to determine the distance and location of the golf ball on the simulated golf hole. User interface means 106, such as the data input keyboard 84 and the data screen 86 of FIG. 3, provide user inputs to the computer system. The computer means 104 controls an imaging means 108 through a control bus 110. The imaging means includes, for example, the projector 82 and the screen 80 of FIG. 3 on which is provided an appropriate image, or split-image. Alternatively, separate imaging means for each golfer are provided with the combination of an imager A 111 and an imager B 112**, which can include separate projectors. The imaging means can include large screen display means and alternative display means, such as holographic goggles.

Figure 5:
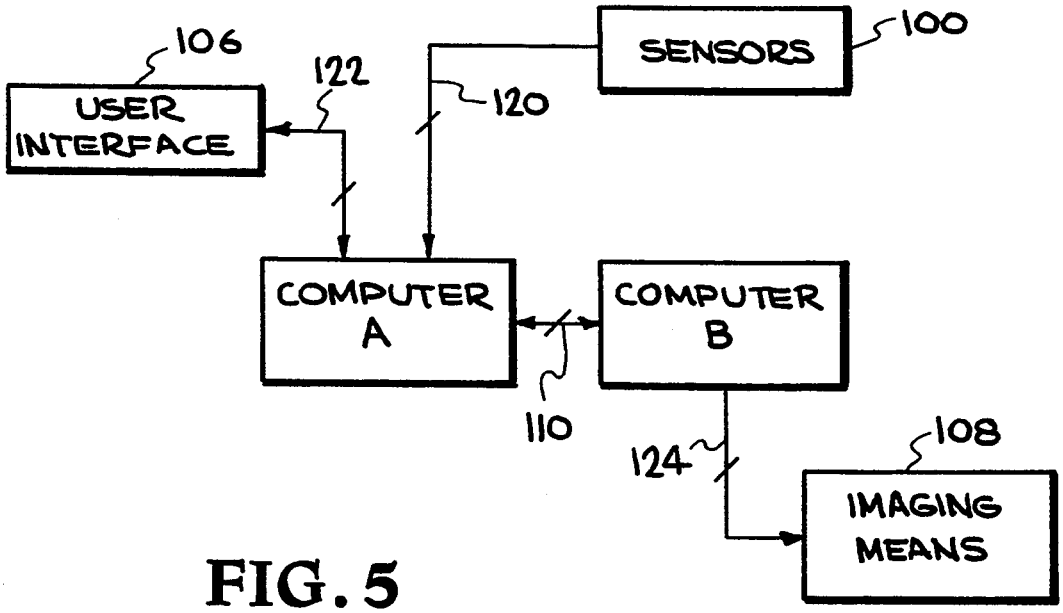
FIG. 5 is an alternative embodiment of an electrical block diagram for a dual-user golf-simulation system according to the invention.

FIG. 5 shows an alternative embodiment of an electrical block diagram for a dual-user golf-simulation system according to the invention. This system includes the sensor means 100, the user interface means 106, and the imaging means 108 of FIG. 4. The sensor means are connected through a bus 120 to a computer A for processing of the sensor information and generation of the flight parameters of the two golf balls. The user interface means 106 is also connected through a bus 122 to computer A. The imaging means is connected through a bus 124 to the output terminals of a computer B, which controls the imaging means. Computer A and computer B interact with each other through a bus 110.

Figure 6:
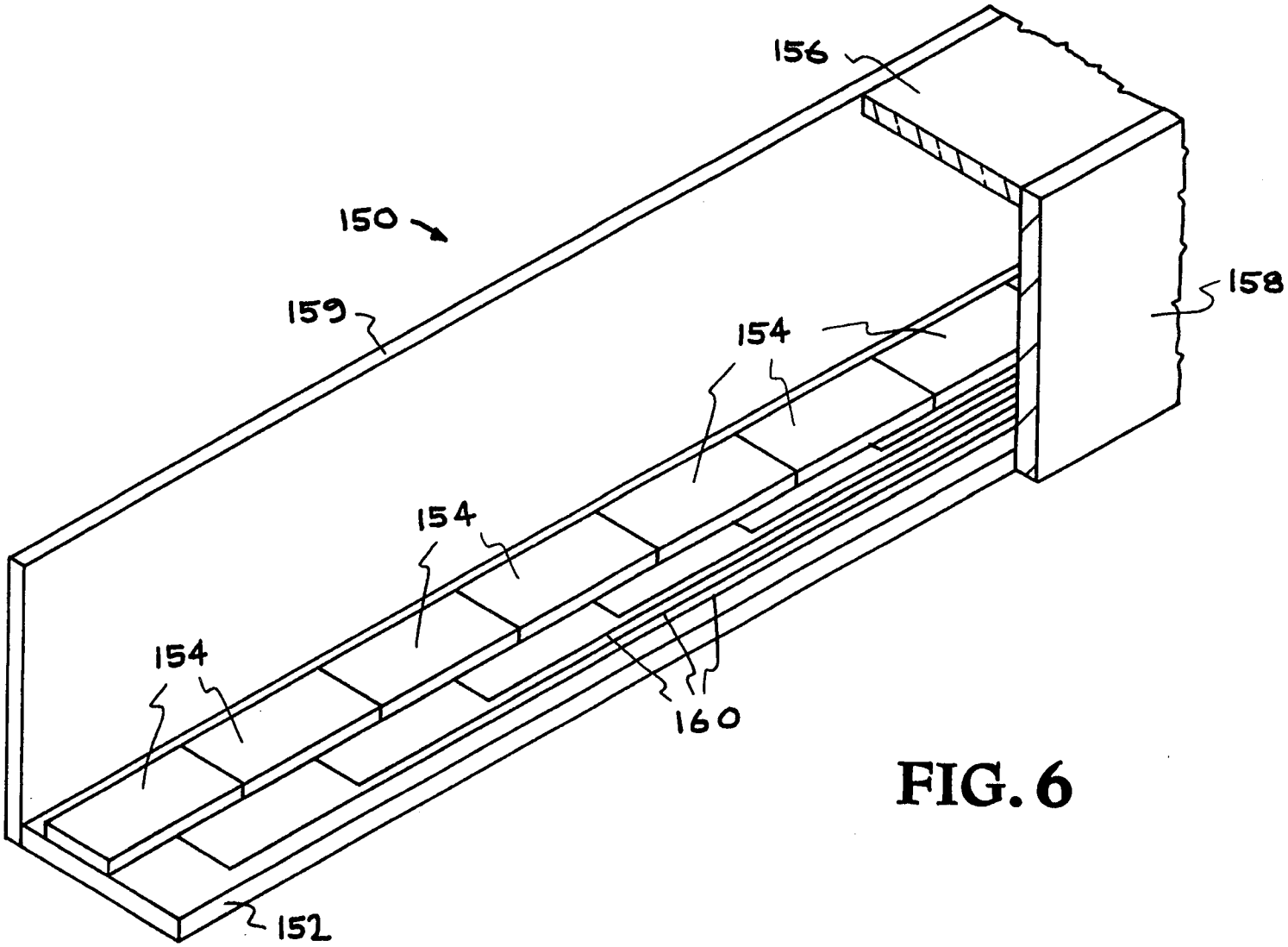
FIG. 6 is a partially cutaway, perspective view of a golf ball flight sensor.

FIG. 6 shows a preferred embodiment of an infrared flight sensor module 150 for a golf ball. As mentioned previously herein above, various types of sensor systems are available for determining various flight parameters of a golf ball being hit by a golfer. One type of sensor system measures the actual flight of a ball, while a second type of sensor system measures certain club head parameters such as clubhead speed and the angle of the face of the clubhead. Infrared transmitters and sensors are often used and the screen 80 of FIG. 3 itself may contain a matrix of impact-sensitive sensor switches. The infrared sensor module 150 can be used with both types of systems.

The sensor module 150 is used to sense infrared radiation from an infrared sources, which is located above the sensor module . The sensor module 150 includes a linear array of horizontally spaced-apart infrared detectors 154 located along a base plate 152. The linear array of infrared detectors 154 is used for detecting the vertically-directed infrared radiation rays. The vertically directed infrared radiation rays are directed through a transparent cover plate 156 to the various infrared detectors. A pair of side plates 159, 160 form part of the enclosure for the sensor module 150 and respectively extend along the length of the sensor module between the cover plate 156 and the base plate 152, as indicated in the Figure.

Each infrared detector 154 forms a detector cell. Each of the detectors 154 has an output terminal with an output current proportional to the total amount of infrared energy striking the detector 154. As a golf ball passes through the infrared radiation, the golf ball blocks some of the radiation going to certain ones of the detector cells 154 and the output currents for the corresponding infrared detectors drop proportionately to the amount of infrared radiation blocked. The currents from the various infrared detectors 154 in the linear array of detectors provide signals for determining the time that the shadow of a golf ball passes over particular ones of the infrared detectors in the array. These signals are provided on signal wires provided in an output wire bundle 160 for the module 150.

In operation, a golf ball passing over the sensor modules casts a shadow on the array. The shadow has the same width, for example, as one of the detector cells. A shadow can straddle two adjacent cells and block a portion of the of infrared radiation. As an example, this causes the output current of one of the cells to drop to 20% of its full value and the output current of the adjacent cell to drop to 80% of its full value. By this technique it is possible to interpolate where the location of the center of the golf ball is located as the golf ball passes over the sensor modules. For the 20%/80% example, the center of the golf ball is located over the one cell at a certain distance from the common boundaries of the cells, where the certain distance is equal to 30% of the width dimension of a cell.

Figure 7:
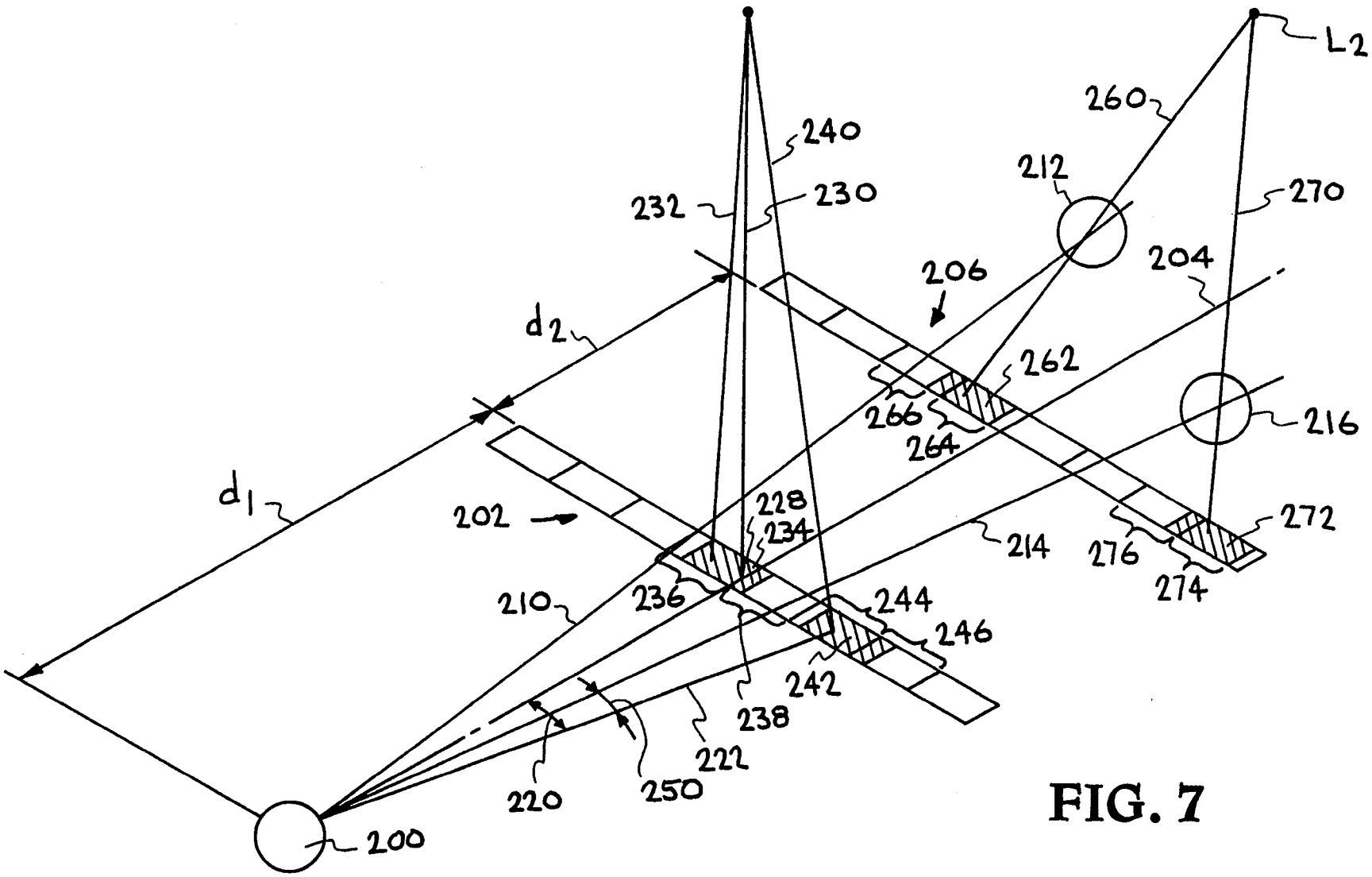
FIG. 7 is a perspective view of a golf ball flight sensor array showing the paths of two golf balls over a pair of sensors.

FIG. 7 shows a perspective view of a ball 200 located, for example, on a tee 72 in one of the tee areas of the booth 50, shown in FIGS. 2 and 3. A first sensor array 202 is spaced apart from the ball 200 by a distance d1 along a reference axis 204. A second sensor array 206 is further spaced apart from the ball 200 by a distance d2 along the reference axis 204. The reference axis 204 extends, with respect to FIGS. 2 and 3, from the tee 72 towards the screen 80. The long axes of the linear arrays 202, 206 extend perpendicularly with respect to the reference axis 204. The sensor arrays 202, 204 lie in or near the plane of the floor of the booth 50 of FIGS. 2 and 3.

The linear arrays are used to gather information about the flight of a golf ball so that the computer system can calculate the flight and landing location of a ball. For explanatory purposes, the flight path 210 of a first driven golf ball 212 and the flight path 216 of a second driven ball are described. The flight paths start at the location of the ball 200 on the tee and extend toward the display screen 80 of FIG. 2 and 3. Some of the variables for a driven ball are the speed, elevation angle, and side angle 220.

The first sensor array 202 is used to measure the side angle of a ball, that is, the angle 220 that the projection 222 of the path of the ball in the plane of the floor takes with respect to the axis 204. A first infrared light source L1 is located above the array 202 and directs infrared rays downward toward the array 202. The light source L1 is located directly above the intersection point 228 of the axis 204 and the center point of the array 202. A perpendicular ray 230 is shown directed downward from the light source L1 to that intersection point 228.

In operation, as the first ball 212 passes over the array 202, infrared energy, as represented by the ray 232, is blocked so that a shadow 234 appears on the array. In this example, approximately 80% of the light to a sensor cell 236 is blocked and approximately 20% of the light to a sensor cell 238 is blocked. This indicates that the ball 212 is heading slightly to the left of the axis 204.

As the second ball 216 passes over the array 202, infrared energy, as represented by the ray 240, is blocked so that a shadow 242 appears on the array 202. In this example, approximately 80% of the light to a sensor cell 244 is blocked and approximately 20% of the light to a sensor cell 246 is blocked. The output signals from these sensor cells then indicate that the first ball 212 is heading away from the tee and to the right of the axis 204, making a side angle 220.

The second sensor array 206 is used to measure the height of a golf ball as the golf ball passes over the second sensor array. The height measurement is used to calculate the elevation angle 250 that the path 214 of the ball 216 makes with respect to the horizontal plane of the floor of the booth. The horizontal plane of the booth is represented, for example, by the projection line 222 of the ball in the plane of the floor.

A second infrared light source L2 is located above the array 206 and directs infrared rays downward toward the array 206. The light source L2 is located to the right side of the axis 204 and almost directly above the far right end of the array 206. This offset location of the light source L2 is utilized to obtain information from which the height of a ball as it passes over the array 206 can be computed.

In operation, as the first ball 212 passes over the array 202, infrared energy, as represented by the ray 260, is blocked so that a shadow 262 appears on the array 206. In this example, approximately 80% of the light to a sensor cell 264 is blocked and approximately 20% of the light to a sensor cell 266 is blocked. This indicates that the shadow 262 is centered somewhat to the left of the axis 204, as indicated in the Figure.

As the second ball 216 passes over the array 206, infrared energy, as represented by the ray 270, is blocked so that a shadow 272 appears on the array 206. In this example, approximately 80% of the light to a sensor cell 274 is blocked and approximately 20% of the light to a sensor cell 276 is blocked. This indicates that the shadow 272 is centered near the right end of the array 206, as indicated in the Figure.

FIG. 8 illustrates a technique for determining the heights of two golf balls above a linear sensor array, based on the output signals from the array 206. The Figure shows an elevation view which is taken in the vertical plane of the sensor and the second infrared light source L2. The top surface of the array 206 is represented by the line 280.

A first golf ball is represented by the point 282. A ray 284 passing from the source L2 is blocked by the first golf ball 282, which casts a shadow, represented by point 286 on the surface 280 of the array 206.

A second golf ball is represented by the point 292. A ray 294 passing from the source L2 is blocked by the second golf ball 292, which casts a shadow, represented by point 296 on the surface 280 of the array 206.

The point 298 is located directly beneath the two balls 282, 292. The point 298 is computed by extrapolating its location from the measured point at which the center of the shadow of a ball passes over the first sensor 202.

Notice that a first triangle is formed between the points 282, 298, and 286. A geometrically similar second triangle is formed between the points 292, 298, and 296. Because these triangles are similar in the geometrical sense, the length of their altitudes (represented respectively by the lines between the points 292–298 and 282–298) are proportional to the length of their bases (represented respectively by the lines between the points 296–298 and 286–298). If the length of the base of a triangle is determined, its altitude, or the height of a ball passing over the array 206, can be computed using a proportionality constant. In this manner, the height of any ball passing over the array 206 can be computed.

The speed of a ball hit from the tee is measured by determining the time difference between the signals which represent, for example, the occurrence of the shadows 242 and 272. The distance between the centers of the shadows 242 and 272 can be computed from the geometrical relationships between the centers. The speed of the ball is computed from the time difference and the distance between shadow centers.

Corrections to account for the linear assumptions in the geometrical models described above can be factored into the various computations.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular us contemplated. It is intended that the scope of the invention be defined by the claims appended hereto and their equivalents.

I claim:

1. A multi-user golf simulation system, comprising:

a booth having a first portion of a tee area for use by a first golfer and a second portion of the tee area for use by a second golfer;

means for determining the flight parameters of a first golf ball hit by a first golfer using a first golf club from the first portion of the tee area and of a second golf ball hit by a second golfer using a second golf club from the second portion of the tee area;

computer means for computing the distance and location of the first golf ball from a first simulated golf hole and of the second golf ball from a second simulated golf hole as a function of the determined flight parameters of each of said first and second golf balls.

2. The multi-user golf simulation system of claim 1 wherein the simulated golf holes represent the same or different golf holes.

3. The multi-user golf simulation system of claim 2 including imaging means, controlled by said computer means, for simultaneously imaging the first simulated golf hole from the location of the first ball and the second simulated golf hole from the location of the second golf ball.

4. The multi-user golf simulation system of claim 3 wherein the imaging means includes means for imaging a different view of the golf hole for each respective player.

5. The multi-user golf simulation system of claim 3 wherein the imaging means includes a display means for presenting an image.

6. The multi-user golf simulation system of claim 5 wherein the display means includes a screen on which is projected an image.

7. The multi-user golf simulation system of claim 5 wherein the display means includes means for projecting respective images of the first simulated golf hole from the location of the first golf ball and the second simulated golf hole from the location of the second golf ball.

8. The multi-user golf simulation system of claim 7 wherein the display means includes a screen on which is projected an image of the first and second simulated golf holes.

9. The multi-user golf simulation system of claim 7 wherein the display means includes a split screen and wherein on one portion of the split screen is displayed the first simulated golf hole from the location of the first golf ball and wherein on another portion of the screen is displayed the second simulated golf hole from the location of the second golf ball such that said first and second golfers may independently and concurrently view the respective simulated golf holes from their respective positions thereon.

10. The multi-user golf simulation system of claim 2 including imaging means, controlled by said computer means, for imaging said first simulated golf hole from the location of the first ball and said second simulated golf hole from the location of the second golf ball.

11. The multi-user golf simulation system of claim 1 wherein the means for determining the flight parameters of said first and second golf balls includes a single sensor means.

12. The multi-user golf simulation system of claim 1 wherein the means for determining the flight parameters of said first and second golf balls includes a separate sensor means for each of said first and second golf balls.

13. The multi-user golf simulation system of claim 1 wherein the means for determining the flight parameters of said first and second golf balls includes a sensor means for determining the flight parameters of said first and second golf balls when struck by said golf club.

14. The multi-user golf simulation system of claim 1 wherein the means for determining the flight parameters of said first and second golf balls includes a sensor means for sensing the parameters of said golf club used to strike said first and second golf balls.

15. The multi-user golf simulation system of claim 1 including user input means.

16. The multi-user golf simulation system of claim 15 wherein the user data input means includes user data input means and display means for the user data input.

17. The multi-user golf simulation system of claim 16 wherein the user data input means includes a user keyboard and the display means includes a screen for displaying the user data input.

18. The multi-user golf simulation system of claim 1 including means for prompting another player to setup on a portion of the tee area.

19. The multi-user golf simulation system of claim 1 wherein the means for determining the flight parameters of said first and second golf balls includes a sensor means for determining characteristics of the club head of said first and second golf clubs when swung by said respective first and second golfers.

20. In a golf simulator booth having screen display means on which are projected various views of simulated golf holes and into which two golfers independently hit golf balls from within the same booth, a dual-player golf simulator system able to be played concurrently by two golfers, said system comprising:

a first portion of a golf tee area to be occupied by a first golfer;

a second portion of the golf tee area to be occupied by a second golfer, playing with the first golfer;

sensing means for determining the flight parameters of two independently hit golf balls, a first ball having been hit by the first golfer using a first golf club and a second ball having been hit by the second golfer using a second golf club;

computer means for computing the flight and landing location of the first golf ball on a first simulated golf hole and the landing location of the second golf ball on a second simulated golf hole, after they have been hit by the respective first and second golfers using said respective first and second golf clubs;

imaging means, controlled by said computer means, for imaging the location of the first golf ball on said first simulated golf hole and the location of the second golf ball on said second simulated golf hole.

21. The dual-player golf simulator system of claim 20 wherein the ball flight sensing means includes separate ball flight sensors for the first portion of the tee area and for the second portion of the tee area.

22. The dual-player golf simulator system of claim 20 wherein the imaging means includes screen means and means for projecting the view of the first simulated golf hole from the location of the first golf ball onto said screen means and for projecting the view of the second simulated golf hole from the location of the second golf ball onto the screen means.

23. The dual-player golf simulator system of claim 20 including computer interface means for permitting each of said golfers to selectably play either singly, independently, or concurrently various simulated golf holes.

24. The dual-player golf simulator system of claim 20 wherein the imaging means selectably provides either an identical view of the same simulated golf hole for both golfers or different views of the same simulated golf hole to each of the respective first and second golfers.

25. The dual-player golf simulator system of claim 18 including means for prompting another player to setup on a portion of the tee area.

26. The dual-player golf simulator system of claim 20 wherein said first and second simulated golf holes are the same golf hole.

* * * * *